US006593952B1

(12) United States Patent
Funayama et al.

(10) Patent No.: US 6,593,952 B1
(45) Date of Patent: Jul. 15, 2003

(54) PRINTER SYSTEM, PRINTER APPARATUS, PRINTING METHOD, INK RIBBON AND PRINTING MEDIUM

(75) Inventors: Hidehiko Funayama, Kanagawa (JP); Shunichi Kamimura, Kanagawa (JP); Teruyasu Hanagami, Kanagawa (JP); Koji Yoshino, Kanagawa (JP)

(73) Assignee: Sony Corporation, Tokyo (JP)

( * ) Notice: Subject to any disclaimer, the term of this patent is extended or adjusted under 35 U.S.C. 154(b) by 191 days.

(21) Appl. No.: 09/595,392

(22) Filed: Jun. 14, 2000

(30) Foreign Application Priority Data

Jun. 14, 1999 (JP) ..... 11-167031
Jun. 14, 1999 (JP) ..... 11-167032
Jun. 14, 1999 (JP) ..... 11-167033

(51) Int. Cl.[7] ..... B41J 32/00; B41J 2/325; B41I 33/14

(52) U.S. Cl. ..... 347/193; 347/214; 347/217

(58) Field of Search ..... 347/188, 214, 347/171–172, 217, 219, 215, 193; 400/208, 611, 196, 612, 207, 613

(56) References Cited

U.S. PATENT DOCUMENTS 5,121,343 A * 6/1992 Faris ..... 347/107
6,236,420 B1 * 5/2001 Matsuzaka ..... 347/171

FOREIGN PATENT DOCUMENTS

| | | |
|---|---|---|
| WO | WO 90/00974 A | 2/1990 |
| WO | WO 94/11196 A | 5/1994 |
| WO | WO 95/24316 A | 9/1995 |
| WO | WO 98/52762 X | 11/1998 |

OTHER PUBLICATIONS

Davis, M. International Search Report on co–pending International Application of Applicant Sony Corporation, prepared Sep. 1, 2000.

* cited by examiner

*Primary Examiner*—John Barlow
*Assistant Examiner*—K. Feggins
(74) *Attorney, Agent, or Firm*—Crosby, Heafey, Roach & May

(57) ABSTRACT

A printer system, a printer apparatus, a printing method, an ink ribbon and a printing medium that certainly and effectively prevent a quality of printed image from being degraded without causing trouble to a user. More concretely, the printing medium is provided with memory mechanisms and the memory mechanisms stores predetermined control data, the printer apparatus reads out the control data stored in the memory mechanisms by contactless communication and controls the photographic printing operation on the basis of the control data which is read out.

39 Claims, 16 Drawing Sheets

| No. | INK COLORS | SPECIAL | OPERATIONS OF PRINTER |
|---|---|---|---|
| 1 | YMC | | PRINTING IN THREE COLORS AND PAPER DISCHARGE |
| 2 | YMC | LAMINATE | LAMINATE TRANSFER AFTER PRINTING IN THREE COLORS AND PAPER DISCHARGE |
| 3 | YMC | DIVIDED INTO FOUR BY STICKER | PRINTING IN THREE COLORS IN STICKER FOUR-DIVISION MODE AND PAPER DISCHARGE |
| : | : | : | : |
| n | WBK | | PRINTING IN TWO COLORS AND PAPER DISCHARGE |
| : | : | | : |

FIG. 1 (RELATED ART)

| OFFSET ADDRESS (BYTE) | DATA FIELD |
|---|---|
| 0 | MANUFACTURER CODE |
| 1 | PRINT(CHRISTIAN ERA) |
| 2 | (MONTH) |
| 3 | (DATE) |
| 4 | J/R No. |
| 5<br>6 | MANAGEMENT CODE |
| 7<br>8 | FACTORY CODE |
| 9<br>10<br>11 | BLANKS |
| 12<br>:<br>15 | RESERVED |

| OFFSET ADDRESS (BYTE) | DATA FIELD |
|---|---|
| 0 | MANUFACTURER CODE |
| 1 | COATING(CHRISTIAN ERA) |
| 2 | (MONTH) |
| 3 | (DATE) |
| 4 | J/R No. |
| 5<br>6 | MANEGEMENT CODE |
| 7<br>8 | SORT |
| 9<br>10<br>11 | BLANKS |
| 12<br>:<br>15 | RESERVED |

| | BLOCK | | | DATA EXAMPLE | | | | | | | | | | | | | | | | CODE CONTENTS |
|---|---|---|---|---|---|---|---|---|---|---|---|---|---|---|---|---|---|---|---|---|
| BL1 | 00h | 0 | MMF | | | | | | | | | | | | | | | | | DATE 1999.05.15 |
| BL2 | 01h | 1 | NAME OF APPARATUS | 55 | 50 | 43 | 2d | 35 | 31 | 30 | 20 | 20 | 20 | 20 | 20 | 20 | 20 | 20 | 20 | UPC-510 |
| | | 2 | KIND | 43 | 4f | 4c | 4f | 52 | 20 | 20 | 20 | 20 | 20 | 20 | 20 | 20 | 20 | 20 | 20 | COLOR |
| | | 3 | NUMBER OF SHEETS USABLE FOR PHOTOGRAPHIC PRINTING | c8 | 20 | 20 | 20 | 20 | 20 | 20 | 20 | 20 | 20 | 20 | 20 | 20 | 20 | 20 | 20 | |
| | | 4 | NUMBER OF USED SHEETS | 20 | 20 | 20 | 20 | 20 | 20 | 20 | 20 | 20 | 20 | 20 | 20 | 20 | 20 | 20 | 20 | 200 |
| | | 5 | RIBBON LOT | 01 | 19 | 99 | 10 | 31 | 01 | 46 | 31 | 35 | 44 | 20 | 20 | 20 | 20 | 20 | 20 | 0 |
| | | 6 | PHOTOGRAPHIC PRINTING PAPER LOT | 01 | 20 | 00 | 01 | 09 | 10 | 46 | 31 | 2a | 2a | 20 | 20 | 20 | 20 | 20 | 20 | PAPER ATTACHED |
| | | 7 | RIBBON ADDRESS | 15 | 36 | 20 | 20 | 20 | 20 | 20 | 20 | 20 | 20 | 20 | 20 | 20 | 20 | 20 | 20 | PAPER ATTACHED |
| | | 8 | RESERVED | 20 | 20 | 20 | 20 | 20 | 20 | 20 | 20 | 20 | 20 | 20 | 20 | 20 | 20 | 20 | 20 | 1536 |
| | | 9 | OEM DESTINATION | 53 | 4f | 4e | 59 | 20 | 20 | 20 | 20 | 20 | 20 | 20 | 20 | 20 | 20 | 20 | 20 | |
| | | 10 | OEM CONTENTS | 4e | 4f | 52 | 4d | 41 | 4c | 20 | 20 | 20 | 20 | 20 | 20 | 20 | 20 | 20 | 20 | SONY |
| | | 11 | RESERVED | 20 | 20 | 20 | 20 | 20 | 20 | 20 | 20 | 20 | 20 | 20 | 20 | 20 | 20 | 20 | 20 | NORMAL |
| | 0Bh | 12 | RESERVED | 20 | 20 | 20 | 20 | 20 | 20 | 20 | 20 | 20 | 20 | 20 | 20 | 20 | 20 | 20 | 20 | |
| | 0Ch | 13 | BLANKS | | | | | | | | ⋮ | | | | | | | | | |
| | | 14 | | | | | | | | | | | | | | | | | | |
| | 0Fh | 15 | | | | | | | | | | | | | | | | | | |
| BL3 | 10h | 16 | CODE | 01 | c8 | 00 | 01 | 01 | 20 | 20 | 20 | 20 | 20 | 20 | 20 | 20 | 20 | 20 | 20 | PAPER ATTACHED |
| | | 17 | MANUFACTURER | 01 | 53 | 4f | 4e | 59 | 20 | 20 | 20 | 20 | 20 | 20 | 20 | 20 | 20 | 20 | 20 | SONY |
| | | 18 | RESERVED | 20 | 20 | 20 | 20 | 20 | 20 | 20 | 20 | 20 | 20 | 20 | 20 | 20 | 20 | 20 | 20 | |
| | | 24 | ⋮ | | | | | | | | ⋮ | | | | | | | | | |
| | 1Fh | 31 | | | | | | | | | | | | | | | | | | |
| BL4 | 20h | 32 | CORRECTING DATA | 59 | 2b | 32 | 2c | 4d | 2b | 33 | 2c | 43 | 2d | 31 | 20 | 20 | 20 | 20 | 20 | Y+2, M+3, C-1 |
| | | 33 | RESERVED | | | | | | | | ⋮ | | | | | | | | | |
| | | 41 | ⋮ | | | | | | | | | | | | | | | | | |
| | 3Eh | 62 | | | | | | | | | | | | | | | | | | |
| | 3Fh | 63 | RESERVED | 20 | 20 | 20 | 20 | 20 | 20 | 20 | 20 | 20 | 20 | 20 | 20 | 20 | 20 | 20 | 20 | |

FIG. 10

| | | UPPER 4 BITS | | | | | | | | | | | | | | | |
|---|---|---|---|---|---|---|---|---|---|---|---|---|---|---|---|---|---|
| | | 0 | 1 | 2 | 3 | 4 | 5 | 6 | 7 | 8 | 9 | A | B | C | D | E | F |
| LOWER 4 BITS | 0 | ▶ | IN | | 0 | @ | P | ‘ | p | ア | ト | ■ | ー | た | み | 組 | 給 |
| | 1 | Ä | IS | ! | 1 | A | Q | a | q | イ | ド | | あ | ち | む | 合 | 排 |
| | 2 | Ü | SH | ” | 2 | B | R | b | r | ウ | バ | | い | つ | め | 確 | 紙 |
| | 3 | Ö | IFT | # | 3 | C | S | c | s | エ | パ | が | う | て | も | 認 | 何 |
| | 4 | ä | S | $ | 4 | D | T | d | t | カ | ブ | ご | え | と | や | 受 | 押 |
| | 5 | ü | P | % | 5 | E | U | e | u | キ | プ | ず | お | な | ゆ | 付 | 動 |
| | 6 | ö | DI | & | 6 | F | V | f | v | コ | ペ | だ | か | に | よ | 実 | 取 |
| | 7 | β | EL | ’ | 7 | G | W | g | w | サ | ボ | づ | き | ぬ | ら | 行 | 待 |
| | 8 | ▪ | O | ( | 8 | H | X | h | x | ジ | メ | で | く | ね | り | 信 | 画 |
| | 9 | ▮ | N | ) | 9 | I | Y | i | y | ス | モ | ど | け | の | る | 号 | 正 |
| | A | ▪ ▪ | OI | * | : | J | Z | j | z | セ | ヤ | ば | こ | は | れ | 上 | EN |
| | B | ▮ ▪ | F | + | ; | K | [ | k | { | ソ | ラ | ぶ | さ | ひ | ろ | 中 | ND |
| | C | ▪ ▮ | → | , | < | L | ＼ | l | ¦ | タ | リ | ゃ | し | ふ | わ | 下 | EX |
| | D | ▮ ▪ | ← | − | = | M | ] | m | } | チ | ル | ゅ | す | へ | を | 入 | IT |
| | E | ▮ ▪ | ↑ | . | > | N | ^ | n | ～ | ツ | レ | ょ | せ | ほ | ん | 出 | |
| | F | ▮ ▮ | ↓ | ／ | ? | O | _ | o | £ | テ | ン | っ | そ | ま | ￥ | 力 | |

FIG. 11

| OFFSET ADDRESS (BYTE) | DATA FIELD |
|---|---|
| 0 | CLASSIFICATION |
| 1 | NUMBER OF SHEETS USABLE FOR PHOTOGRAPHIC PRINTING |
| 2 | NUMBER OF ACTUALLY PRINTED SHEETS |
| 3 | OEM DESTINATION |
| 4 | OEM CONTENTS |
| 5 | RESERVE |
| 6 | |
| ⋮ | |
| 15 | |

PRINTER SYSTEM, PRINTER APPARATUS, PRINTING METHOD, INK RIBBON AND PRINTING MEDIUM

BACKGROUND OF THE INVENTION

1. Field of the Invention

The present invention relates to a printer system, a printer apparatus, a printing method, an ink ribbon and a printing medium, and more particularly, is suitably applied to a printer system in which photographic printing is performed by allowing a coloring material to adhere to a printing medium or allowing a printing medium which develops a color by itself to develop the color.

2. Description of the Related Art

In the conventional thermal transfer type printer apparatus, shapes and images such as characters, numerals and figures on the basis of supplied photographic printing data are visibly displayed by thermal transferring of ink such as a dye coated on a surface of an ink ribbon (hereinafter referred to as an ink surface of the ink ribbon) to photographic printing paper.

Prepared in this case as ink ribbons which are to be used for such a thermal transfer type printer apparatus are an ink ribbon which has three ink colors of yellow (Y), magenta (M) and cyanic (C), an ink ribbon which has two ink colors of white (W) and black (Bk), etc. and the ink ribbon of a three-color type is classified into a laminated type, a sticker four division type or the like as shown in FIG. 1.

Since the ink ribbons are prepared in many kinds as described above and different kinds of ink ribbons require different conditions for photographic printing, it is necessary, when using plural kinds of ink ribbons in one printer apparatus, to switch an operation mode to a mode corresponding to an ink ribbon to be used each time an ink ribbon is exchanged with another.

Accordingly, there has been proposed a method which configures a printer apparatus, for example, as shown in FIG. 2 wherein a ring 3 is rotatably disposed at an end of a supply spool 2 for an ink ribbon 1, codes representing a kind code of the ink ribbon 1 and a number of sheets usable for photographic printing are recorded with hot stamps as bar codes on an outer circumferential surface of the ring 3, and on the other hand, the kind code, etc. are read with an inexpensive reflection type sensor on a side of the printer apparatus so that an operation mode can be automatically switched to a corresponding mode on the basis of a read result.

This method automatically switches the operation mode of the printer apparatus to the corresponding mode dependently on a kind of the ink ribbon 1 to be used, thereby preventing a trouble from being caused due to mismatch between the operation mode of the printer apparatus and the kind of the ink ribbon 1 or the like.

However, such a method may allow the bar codes recorded on a circumferential side surface of the ring 3 to be erased or partially cut off due to rubbing, thereby changing data. When the bar codes are erased or altered due to rubbing as described above, the printer apparatus cannot recognize the kind of the ink ribbon 1 correctly, whereby a quality of a photographically printed image may be degraded due to mismatch between an operation mode set by the printer apparatus and the kind of the ink ribbon 1.

On the other hand, ink colors of ink ribbons even of the same kind are liable to be delicately changed dependently on manufacturing lots, whereby balance and densities of colors of photographically printed images may be delicately different even when the same kind of ink ribbon is used.

In order to prevent the balance and the densities of the colors of the photographically printed images from being changed as described above, there has been conceived a method which preliminarily gives data on manufacturing dispersion of an ink ribbon to be used (hereinafter referred to as manufacturing dispersion correcting data) to a printer apparatus, a personal computer which controls the printer apparatus or the like and photographically prints images on the basis of image data which has been corrected on the basis of the manufacturing dispersion correcting data.

As a method of giving the manufacturing dispersion correcting data of the colors of the ink ribbon to the printer or the like in this case, there is available a method which expresses manufacturing dispersion of the ink colors as numerical values and record the numerical values on a surface of a package box of the ink ribbon so that a user can input the numerical values into the printer apparatus or the like when using the ink ribbon.

However, this method makes it necessary for the user to input the manufacturing dispersion correcting data of each ink color of the ink ribbon into the printer apparatus or the like each time the ink ribbon is exchanged with another, thereby posing a problem that it is not convenient to use.

Furthermore, when the user forgets to input the manufacturing dispersion correcting data, this method allows correction processings to be performed on the basis of manufacturing dispersion correcting data which was input precedently, thereby posing a problem that actual manufacturing dispersion of each ink color is mismatched with correction processing by the printer apparatus or the like, and the mismatched correction processing may further degrade balance and densities of colors on photographically printed images, and another problem that similar inconvenience is produced when the package box of the ink ribbon is lost.

As another method to give the manufacturing dispersion correcting data of the ink ribbon to the printer apparatus, it is further conceivable to use a method which records the manufacturing dispersion correcting data together with the type codes or the like with hot stamps on the outer circumferential surface of the ring attached to the supply spool 2 (FIG. 2) described above.

However, the method which records the data with hot stamps allows data to be recorded only in an amount on the order of 12 to 13 bits at most and makes it difficult to reserve a recording capacity sufficient to record the manufacturing dispersion correcting data, and even when hot stamps are forcibly configured by recording the manufacturing dispersion correcting data for each ink color, the method poses a problem of high manufacturing cost since the method requires preparing prints of the hot stamps for each production lot of the ink ribbon and changing these prints each manufacturing lot.

On the other hand, the conventional printer apparatus counts frequency generator (FG) pulses (changing dependently on a winding diameter of the ink ribbon) which are given for a definite section from a driving mechanism section for the ink ribbon at a stage to photographically print an image on a first sheet after a power source is turned on and estimates an approximate residual amount of an ink ribbon on the basis of a count result.

Such a printer apparatus is configured by determining driving voltages for motors which drive the supply spool and the take-up spool for the ink ribbon on the basis of an estimation result and apply driving voltages corresponding to a determination result to these motors, thereby always giving a definite tension to the ink ribbon.

However, this method poses a problem that it is low in accuracy and that it cannot perform correct control of the tension of the ink ribbon since the method performs the tension control on an assumption of, for example, about half an amount at a time to photographically print the image on the first sheet. When the tension of the ink ribbon is not controlled correctly as described above, there is proposed a problem that qualities of photographically printed images are degraded due to printing wrinkles, color deviation in a feeding direction, skew (color deviation in a rotating direction) or the like.

SUMMARY OF THE INVENTION

In view of the foregoing, an object of this invention is to provide a printer system, a printer apparatus, a printing method, an ink ribbon and a printing medium which are capable of certainly and effectively preventing qualities of photographically printed images from being degraded without causing trouble to a user.

The foregoing object and other objects of the invention have been achieved by the provision of a printer system composed of a printing medium and a printer apparatus. The printing medium comprises: a first antenna; memory means which stores predetermined control data; and first communicating means which communicates with an outside by way of the first antenna, and reads out the control data out of the memory means and outputs the data to the outside by way of the first antenna in response to a request from the outside. And the printer apparatus comprises: photographic printing means which prints an image on the basis of photographic printing data by allowing the coloring material of the printing medium to adhere to the photographic printing medium or allowing the photographic printing means which develops the color by itself to develop the color; a second antenna which is disposed in correspondence to the first antenna; second communicating means which communicates by non-communication contact with the first communicating means by way of the second and first antennae; and control means which reads out the control data from the storage means by way of the second and first communicating means and executes predetermined control processing on the basis of the control data which is read out.

As a result, according to this printer system, it is possible to effectively prevent data loss and data alteration and also in the printer apparatus it is possible to execute effective photographic printing control on the basis of the control data.

Furthermore, the present invention provides a printing method comprising the steps of: disposing memory means integrally with the photographic printing medium to which the coloring material is to adhere or the photographic printing medium which develops the color by itself and storing predetermined control data into the memory means; and reading out the control data stored in the memory means by the contactless communication and controlling the photographic printing operation on the basis of the control data which is read out.

As a result, according to the printing medium, it is possible to execute effective photographic printing control on the basis of the control data while effectively preventing data loss and data alteration.

Furthermore, the present invention provides a printer apparatus comprising: communicating means which communicates contactlessly with data storage and communicating means which is disposed integrally with the coloring material or the photographic printing medium which develops the color by itself, and has a data storage function and a contactless communicating function; and control means which reads out control data preliminarily stored in the data storage and communicating means by way of the communicating means, and executes predetermined control processing on the basis of the control data which is read out.

As a result, according to this printer apparatus, it is possible to execute effective photographic printing control without having a user input data.by storing the control data necessary for the photographic printing control in the data storage and communicating means.

Furthermore, the present invention provides a printing method comprising the steps of: communicating with data storage and communicating means which is disposed integrally with the coloring material or the photographic printing medium which develops the color by itself and has a data storage function and a contactless communicating function, and reading out control data preliminarily stored in the data storage and communicating means by contactless communication; and controlling an photographic printing operation on the basis of the control data which is read out.

As a result, according to this printing method, it is possible to execute effective photographic printing control without having a user input data by storing the control data necessary for the photographic printing control in the data storage and communicating means.

Furthermore, the present invention provides an ink ribbon comprising: an antenna disposed integrally with the ribbon; communicating means for performing communication with an outside by way of the antenna; and memory means for storing data, wherein the data obtained by the communication with the outside is stored in the memory means at need, and/or the data stored in the memory means is read out at need and output to the outside by the communication.

As a result, this ink ribbon is capable of maintaining data necessary for photographic printing control while effectively preventing data loss and data alteration.

Furthermore, the present invention provides a printing medium comprising: an antenna disposed integrally with the coloring material or the photographic printing medium which develops the color; communicating means for performing communication with an outside by way of the antenna; and memory means for storing data, wherein the data obtained by the communication with the outside is stored into the memory means as occasion demands and/or the data stored in the memory means is read out as occasion demands and output to the outside by the communication.

As a result, this printing medium is capable of maintaining data necessary for photographic printing control while effectively preventing data loss and data alteration.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIG. 1 is a diagram descriptive of kinds of ink ribbons;

FIG. 10 is a diagram descriptive of concrete data contents and data formats in an EEPROM of the tag;

FIG. 11 is a diagram descriptive of character codes used in this embodiment;

DETAILED DESCRIPTION OF THE EMBODIMENT

Preferred embodiments of this invention will be described with reference to the accompanying drawings:

(1) Configuration of Printer System According to Embodiment

Figure 2A:
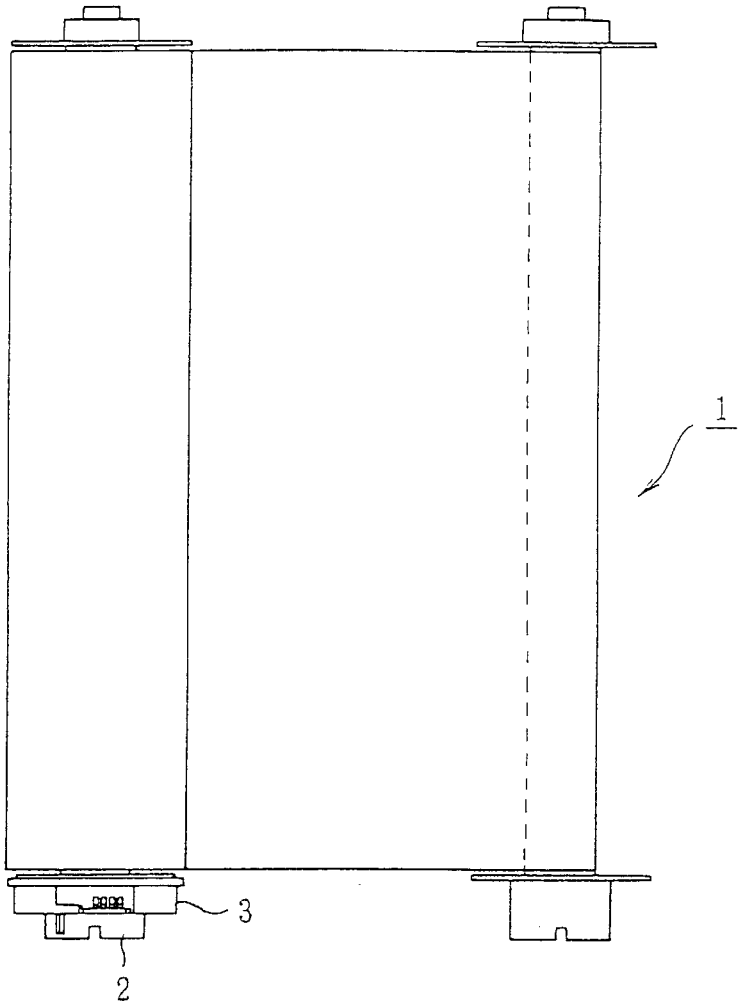
FIG. 2A (RELATED ART)
FIGS. 2A and 2B are a top view and a side view showing an example of configuration of a conventional ink ribbon.
Figure 2B:
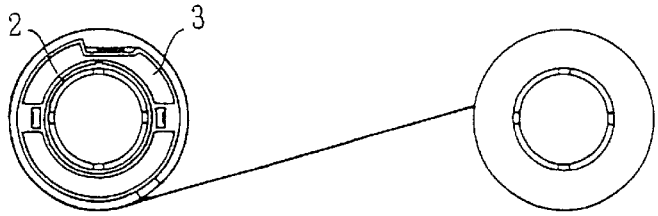
FIG. 2B (RELATED ART)
Figure 3:
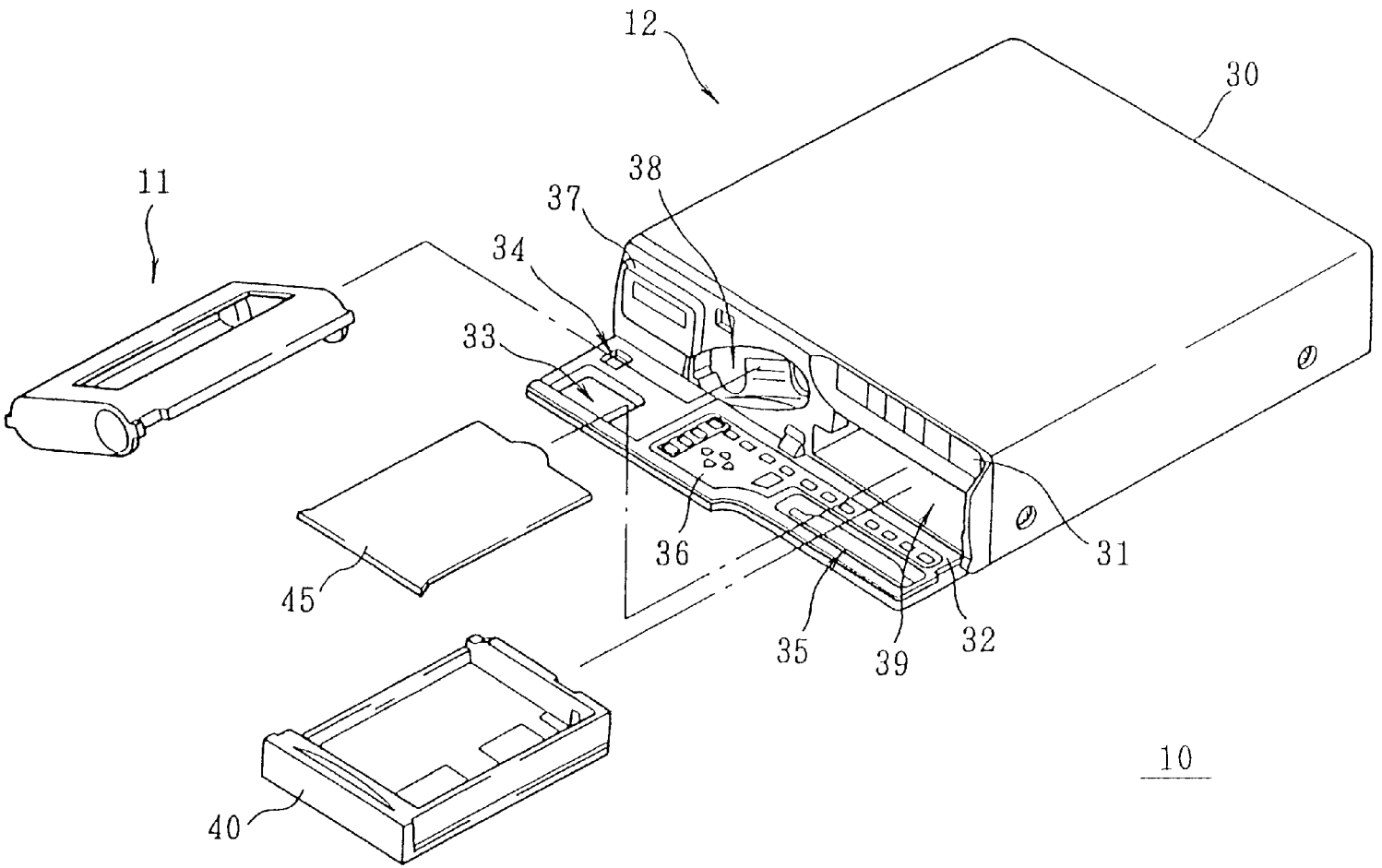
FIG. 3 is a perspective view showing a configuration of a printer system according to this embodiment.

In FIG. 3, reference numeral 10 denotes a printer system according to this embodiment as a whole, which comprises a ribbon cartridge 11 and a printer apparatus 12.

Figure 4:
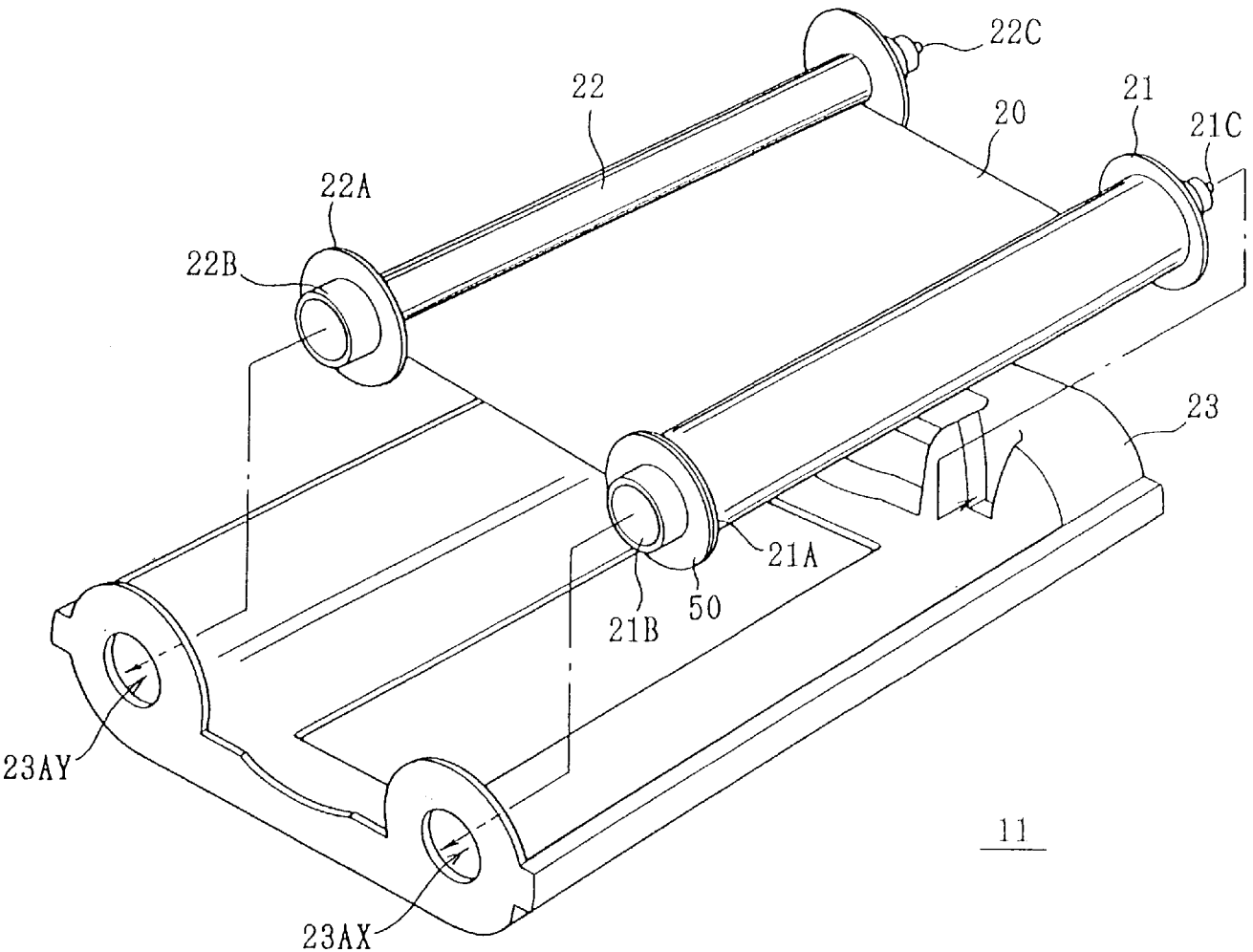
FIG. 4 is a exploded perspective view showing a configuration of a ribbon cartridge.

The ribbon cartridge 11 comprises, as shown in FIG. 4, an ink ribbon 20 which is a belt-like ribbon coated on a surface with ink of a singularity or plurality colors in a predetermined pattern, a supply spool 21 around which the ink ribbon 20 is wound, a take-up spool 22 which holds an end of the ink ribbon 20 drawn out from the supply spool 21 and a holder 23.

Cylindrical portions 21B and 22B which are formed after collar portions 21A and 22A formed at rear ends of the supply spool 21 and the take-up spool 22 are fitted into apertures 23AX and 23AY bored in a rear end wall of the holder 23, and protrusions 21C and 22C formed at a front end are fitted into corresponding concave portions (not shown) formed in a front end of the holder 23, whereby the supply spool 21 and the take-up spool 22 are held by the holder 23 so as to be in parallel and rotatable.

On the other hand, the printer apparatus 3 has, as apparent from FIG. 3, a first operation panel 31 which is disposed on a front surface of a console 30 and has a plurality of operation buttons, and an openable/closable door section 32 which is disposed on the front surface of the console 30 so as to avoid the first operation panel 31.

In this case, an aperture 33 for a liquid crystal display panel, an aperture 34 for a power switch and an aperture 35 for paper discharge are formed in the door section 32, whereas a second operation panel 36 on which has a plurality of operation buttons is disposed inside the door section 32 while avoiding the aperture 33 for the liquid crystal display panel, the aperture 34 for the power switch and the aperture 35 for paper discharge.

Furthermore, a liquid crystal display panel 37 and a power switch (not shown) are disposed on an inside front surface of the console 30 which is concealed by the door section 32 so as to correspond to the aperture 33 for the liquid crystal display panel and the aperture 34 for the power switch on the door section 32, so that various messages displayed on the liquid crystal display. panel 37 can be watched through the aperture 33 for the liquid crystal display panel of the door section 32 and the power switch can be manipulated even in a condition where the door section 32 is kept closed.

Furthermore, a ribbon cartridge charging port 38 and a paper tray charging port 39 are formed in the inside front surface of the console 30, so that a ribbon cartridge 11 and a paper tray 40 can be charged into the console 30 through the ribbon cartridge charging port 38 ad the paper tray charging port 39 respectively.

Figure 5:
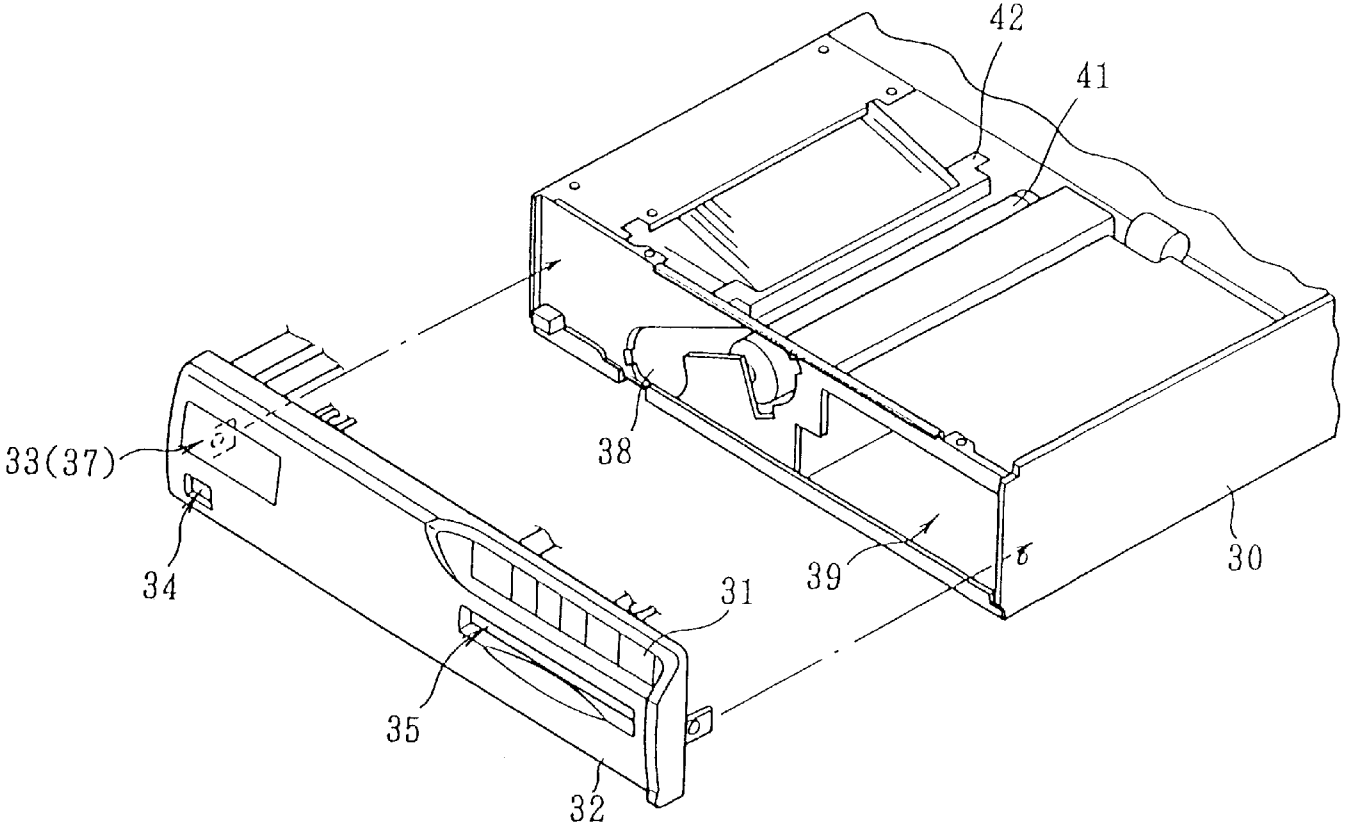
FIG. 5 is a schematic exploded perspective view descriptive of an internal configuration of a printer apparatus.

As shown in FIG. 5, a platen 41 and a thermal head 42 are disposed at predetermined locations respectively in the console 30 so as to correspond to a charging location of the ribbon cartridge 11, and a mechanism which rotatingly drives the platen 41 and presses the thermal head 42 to the platen 41 under a predetermined pressure at a time of photographic printing time is disposed in the vicinity of the platen 41 and the thermal head 42.

Figure 6:
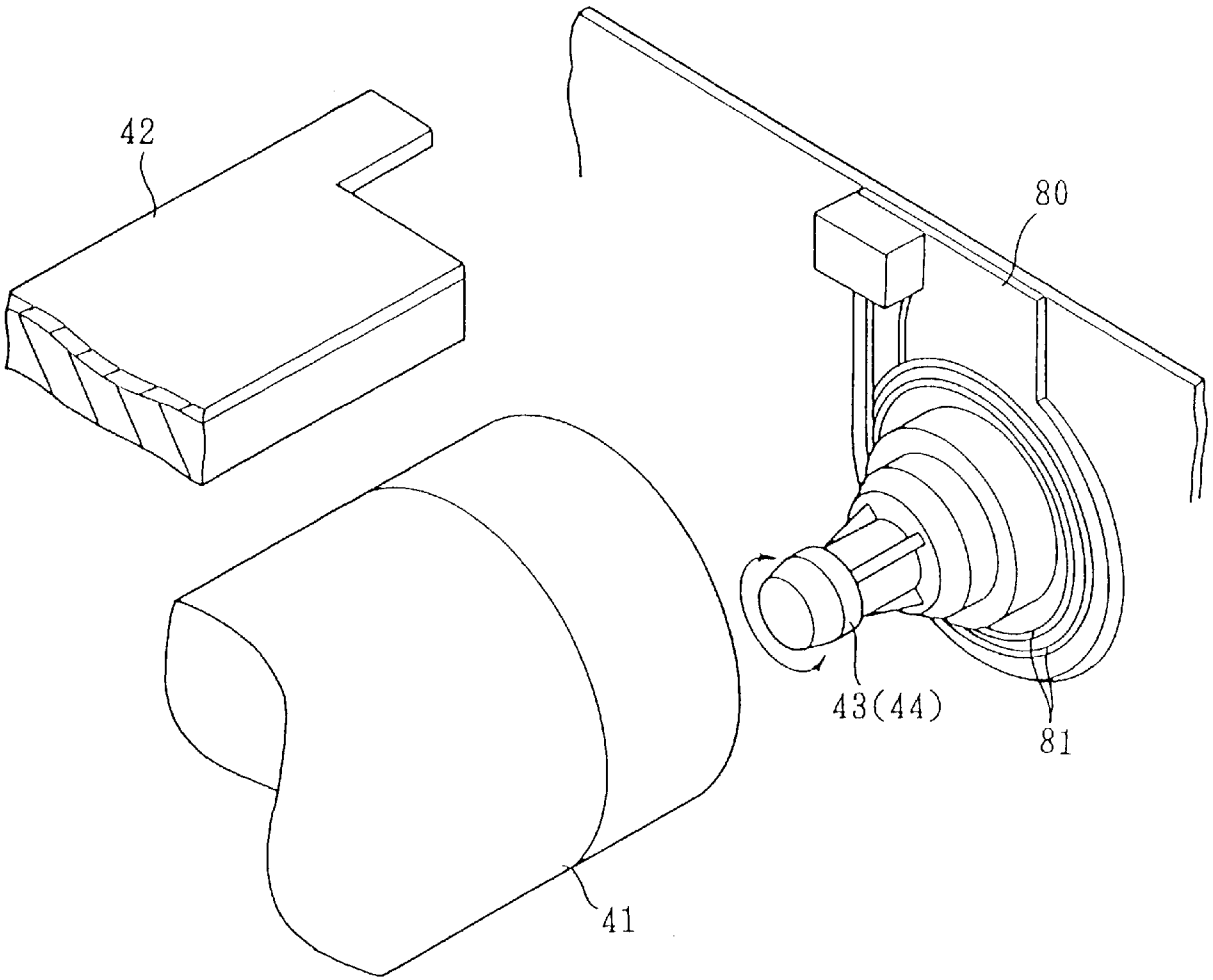
FIG. 6 is a schematic perspective view descriptive of the internal configuration of the printer apparatus.
Figures 7, 12A, 12B:
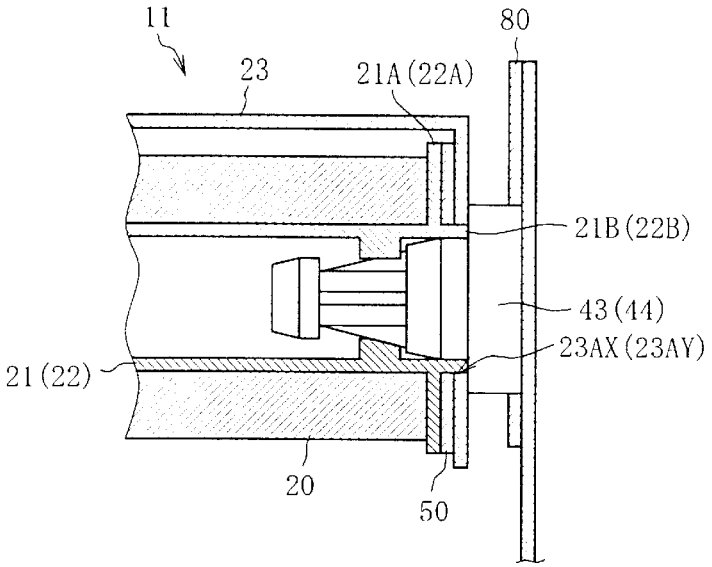
FIG. 7 a partial sectional view showing the ribbon cartridge charged in the printer apparatus.
FIGS. 12A and 12B are diagrams descriptive of concrete data contents and data formats in a ribbon lot column and a photographic printing paper lot column in FIG. 10.

As shown in FIG. 6, first and second torque limiters 43 and 44 are disposed in the console 30 so as to correspond to the mounting location of the ribbon cartridge 11 so that the torque limiters can be fitted into the cylindrical portions 21B and 22B of the supply spool 21 or the take-up spool 22 of the ribbon cartridge 11 can be fitted as shown in FIG. 7 when the ribbon cartridge 11 is charged, whereby the ink ribbon 20 of the ribbon cartridge 11 (FIG. 4) can be fed or wound back and a desired tension can be given to the ink ribbon 20 by rotatingly driving the first and second torque limiters 43 and 44.

Furthermore, a mechanism for carrying photographic printing sheets is disposed so as to correspond to a mounting location of the paper tray 40 in the console 30 so that the mechanism can take out photographic printing sheets one by one from the paper tray 40 and carry the sheet so as to be wound around the platen 41, and after photographic printing of an image, feed out the sheet onto a delivery tray 45 which is set over the paper tray 40 (FIG. 3).

Figure 8:
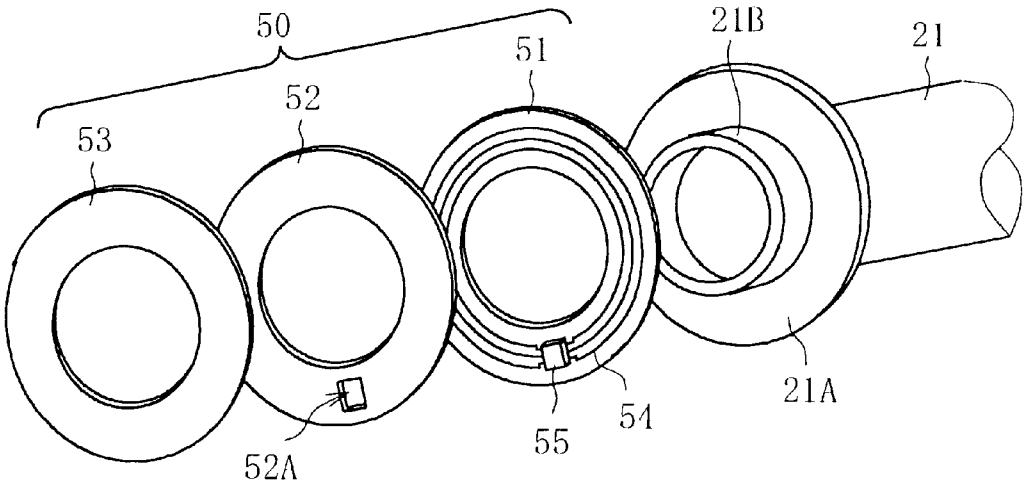
FIG. 8 is a schematic exploded perspective view showing a configuration of a tag.

In addition to components of the printer system 10 described above, a tag 50 which is composed by laminating sequentially and integrally a ring-like flexible wiring plate 51, a ring-like protective film 52 and a ring-like protective sheet 53 is bonded to a rear surface of the collar portion 21A of the supply spool 21 of the ribbon cartridge 11 as shown in FIGS. 4 and 8.

In this case, a loop-like antenna (hereinafter referred to as a tab or tab side antenna) 54 which is composed of patterns on a surface of a flexible wiring plate 51 and a memory IC chip 55 which is composed of a semiconductor integrated circuit chip is mounted so as to be electrically connected to the tab side antenna 54.

Furthermore, the protective film 52 is formed so as to be as thick as the memory IC chip 55 and bended to the surface of the flexible wiring plate 51 so that the memory IC chip 55 is fitted into an aperture 52A disposed at a predetermined location.

Furthermore, the protective sheet 53 is made of a material which has hardness higher than that of the protective film 52 and bonded to the protective film 52 so as to oppose to the surface of the flexible wiring plate 51 by way of the protective film 52.

Figure 9:
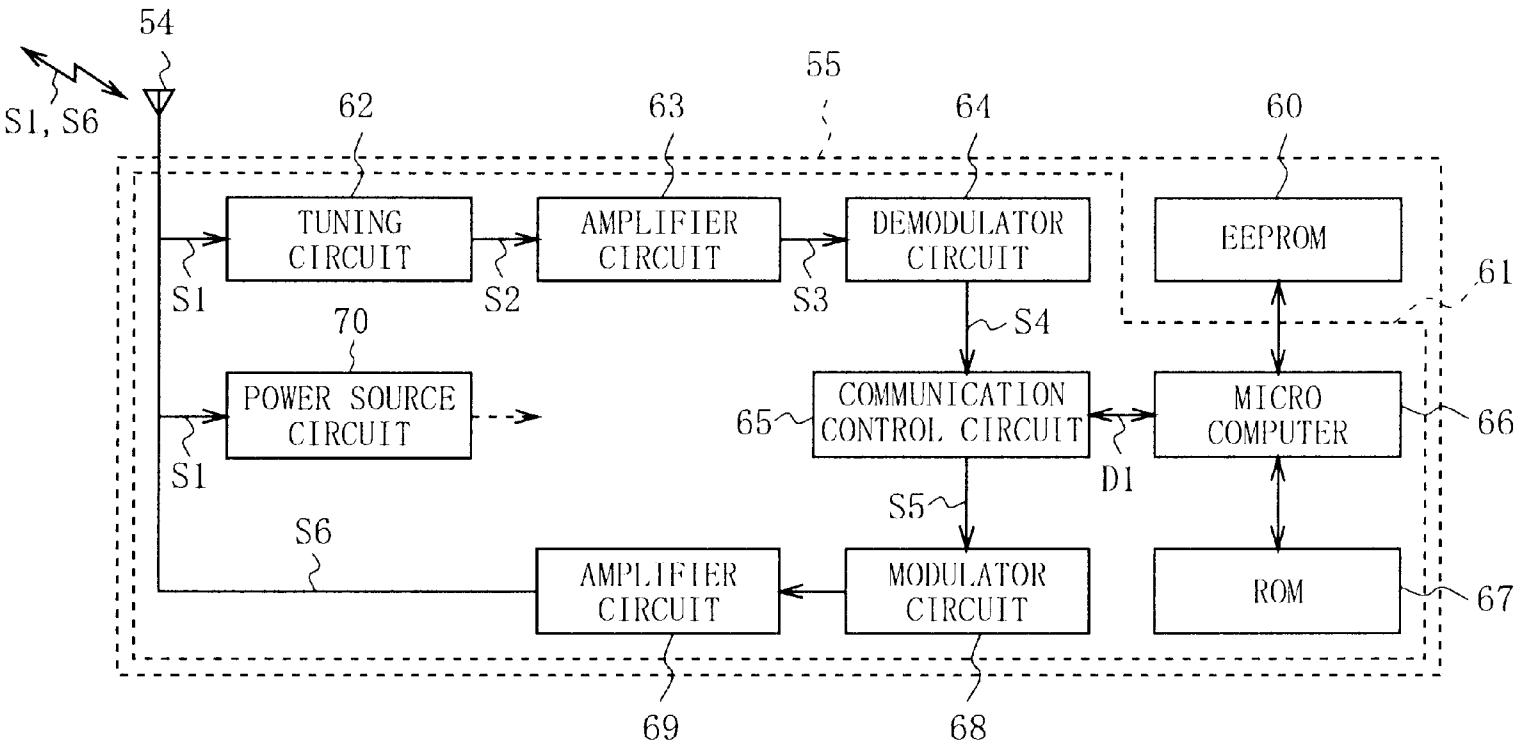
FIG. 9 is a block diagram showing a configuration of a memory IC chip.

As shown in FIG. 9, formed on the memory IC chip 55 is a communicating section (hereinafter referred to as a tab side communicating section) 61 which is configured so as to be capable of communicating with an outside by way of an electrically erasable programmable ROM (EEPROM) 60 which preliminarily stores data such as a kind of the ink ribbon 20, a number of sheets usable for phonographic printing sheets and a number of sheets actually used for photographic printing of the ribbon cartridge 11 (FIG. 4), and the tab side antenna 54.

In this case, the tab side communicating section 61 receives a transmission signal S1 given from the outside with the tab side antenna 54 and inputs the signal into a tuning circuit 62. The tuning circuit 62 separates and extracts a signal component having a predetermined carrier frequency from the supplied transmission signal S1 and sends out an obtained information component signal S2 to a demodulator circuit 64 by way of an amplifier circuit 63.

The demodulator circuit 64 demodulates the supplied information component signal S2 and sends out an obtained data signal S3 to a communication control circuit 65. Furthermore, the communication control circuit 65 converts the data signal S3 into digital data and sends out obtained digital data to a micro computer 66.

When a write a write request command is given as the digital data, for example, the micro computer 66 stores data which is given together with the write request command at a corresponding address location in the EEPROM 60 on the basis of a program stored in a read only memory (ROM) 67.

When a read request command is given as the digital data, the micro computer 66 reads out corresponding data stored in the EEPROM 60 and sends out this data to the communication control circuit 65.

The communication control circuit 65 converts the supplied data into analog data and sends out an obtained read data signal S5 to a modulator circuit 68. Furthermore, the modulator circuit 68 demodulates the supplied read data signal S5 into a predetermined carrier frequency and transmits an obtained transmission signal S6 to the outside by way of an amplifier circuit 69 and the tab side antenna 54.

Furthermore, transmission signal S1 output from the tab side antenna 54 is given also to a power source circuit 70. The power source circuit 70 takes out an energy from the transmission signal S1 and sends out a required driving voltage to the circuits 62 to 69.

As described above, the tag 50 of the ribbon cartridge 11 is configured so as to be capable of writing required data into the EEPROM 60 in the memory IC chip 55 according to a write request and a read request from the outside, and reading out the data stored in the EEPROM 60 and sending out the data to the outside.

Concrete contents of the data stored in the EEPROM 60 of the tag 50 and concrete data format of the data are shown in FIG. 10.

As apparent from FIG. 10, a memory area of the EEPROM 60 of the tag 50 is divided into a plurality of blocks and management data of the tag 50 is stored in a first block (00h) BL1.

Stored in a successive block (01h through 0Fh) BL2 are a model name of the ribbon cartridge 11 to which the tag 50 is attached, the kind of the ink ribbon 20 (FIG. 4), the number of sheets usable for photographic printing, the number of used sheets, the address of the ink ribbon, the name of a client (in OEM business) and specifications for the client which are expressed using character codes shown in FIG. 11 as character rows each within 16 characters.

Stored in the block BL2 are ribbon lot data and lot data of photographic printing sheets such as manufacturing dates and lot numbers of the ink ribbon 20 and photographic printing sheets placed on the market as a set with the ink ribbon 20, in such a data format as shown in FIGS. 12A and 12B respectively.

Figures 13, 16:
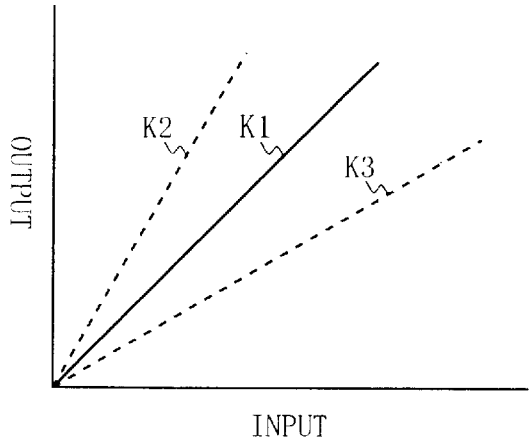
FIG. 13 is a diagram descriptive of concrete data contents and data formats in a code column in FIG. 10.
FIG. 16 is a graph descriptive of γ data correction processing.

Furthermore, stored in a successive block (10h through 1Fh) BL3, for example, in the order shown in FIG. 13 are codes of the kind of the ink ribbon 20, the number of sheets usable for photographic printing, the number of sheets actually used for photographic printing, the name of a client and specifications for the client as well as a name of a manufacturer company of the ink ribbon 20 as character rows within 16 characters using the character codes shown in FIG. 11.

Stored in a successive block (20h to 7Eh) BL4 are manufacturing dispersion correcting data for correcting manufacturing dispersion of colors of the ink ribbon 20 or the like. In this case, the manufacturing dispersion correcting data is numerical values ("+2", "+3", "−1") which represent density difference between ink colors and a standard color such as yellow+2, magenta+3 and cyan−1 and these numeral values are stored sequentially into corresponding areas.

As apparent from FIG. 6 on the other hand, disposed in the printer apparatus 12 is a printed wiring plate 80 so as to surround the first torque limiter 43 described above which is to be fitted into the cylindrical portion 21A of the supply spool 21 of the ribbon cartridge 11.

Figure 14:
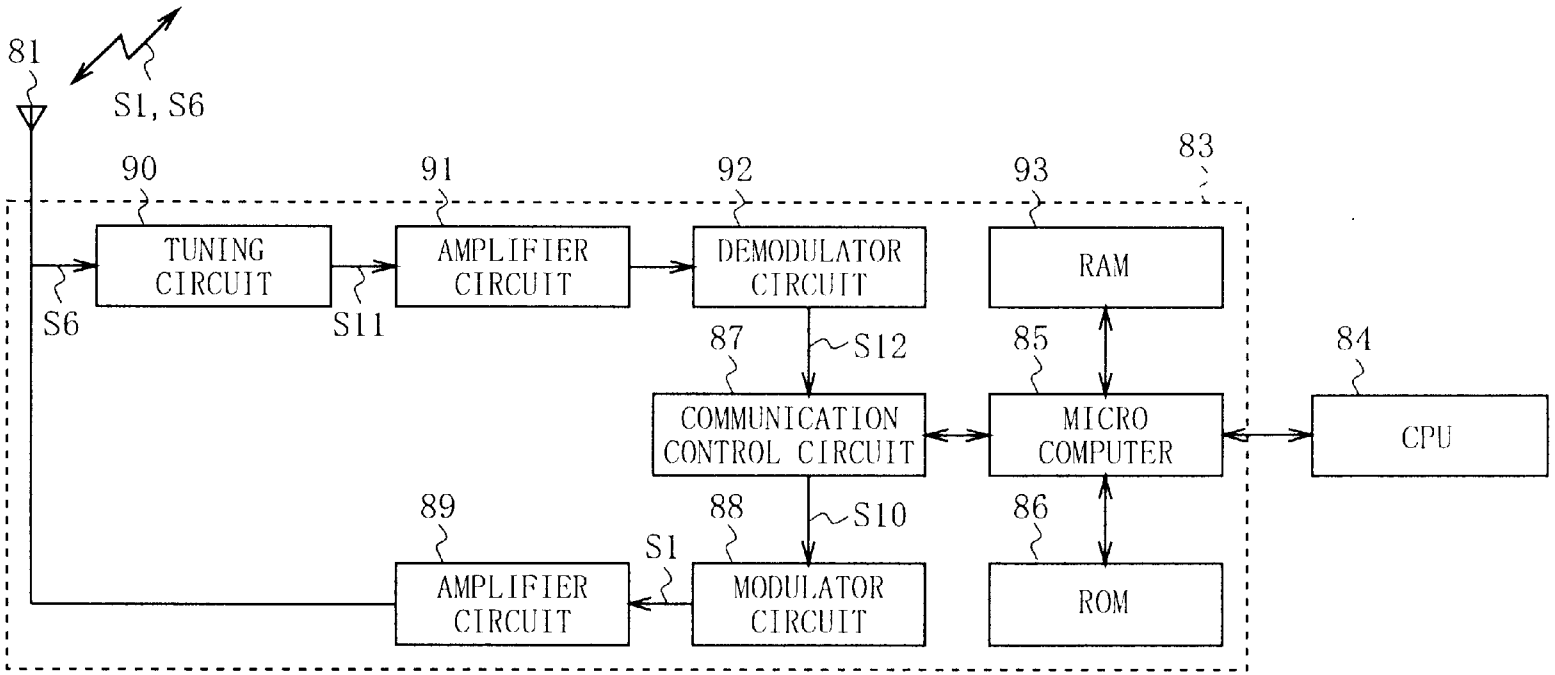
FIG. 14 is a block diagram showing a configuration of a printer side communicating section.

Furthermore, a loop-like antenna (hereinafter referred to as printer side antenna) 81 which is composed of wiring patterns is formed on a surface of the printed wiring plate 80 which is opposed to the ribbon cartridge 11 and a communicating section (hereinafter referred to as printer side communicating section) 83 which is disposed in the printer apparatus and configured as shown in FIG. 14 is connected to the printer side antenna 81.

When the ribbon cartridge 11 is charged into the printer apparatus 12 (FIG. 7), the printer side antenna 81 is opposed concentrically with the tab side antenna 54 of the tag 50 attached to the ribbon cartridge 11 at a predetermined distance, whereby the printer side communicating section 83 is capable of communicating with the tab side communicating section 61 by way of the printer side antenna 81 and the tab side antenna 54.

In this case, the printer side communicating section 83 is configured by communicating with the tab side communicating section 61 under control by a CPU 84 which governs operation control of the printer apparatus 12 as a whole and when a command to read data from the EEPROM 60 of the tag 50 is actually given from the CPU 84, for example, a micro computer 85 sends out a read request command to a communication control circuit 87 on the basis of a program stored in a ROM 86.

The communication control circuit 87 converts the supplied read request command into an analog signal and sends out an obtained analog signal S10 to a modulator circuit 88. The modulator circuit 88 modulates the supplied analog signal S10 into a predetermined carrier frequency and transmits an obtained transmission signal S11 to the tag side antenna 54 of the ribbon cartridge 11 sequentially by way of an amplifier circuit 89 and the printer side antenna 81.

As a result, the printer side communicating section 83 receives the transmission signal S6 output from the tab side communicating section 61 by way of the printer side antenna 81 as described above and inputs this signal into a tuning circuit 90.

The tuning circuit 90 separates and extracts a signal component having a predetermined carrier frequency from the supplied transmission signal S6 and sends out an obtained information component signal S11 to a demodulator circuit 92 by way of an amplifier circuit 91. The demodulator circuit 92 demodulates the supplied information component signal S11 and sends out an obtained data signal S12 to the communication control circuit 87.

The communication control circuit 87 converts the supplied data signal S12 into digital data and sends out obtained digital data which consists of the data read out of the EEPROM 60 of the tag 50 to the micro computer 85.

The micro computer 85 stores the supplied digital data once into a RAM 93, reads out the digital data at a predetermined timing and sends out this digital data to the CPU 84.

When an instruction to write data into the EEPROM 60 of the tag 50 and data to be written are given from the CPU 84, the micro computer 85 sends out a write request command and the data to the communication control circuit 87. The communication control circuit 87 converts the supplied write request command and the data into an analog signal, and sends out an obtained analog signal S10 to the modulator circuit 88.

The modulator circuit 88 converts the supplied analog signal S10 into a predetermined carrier frequency and transmits an obtained transmission signal S1 to the tab side antenna 54 sequentially by way of the amplifier circuit 89 and the printer side antenna 81. As a result, as described above, the data is stored into the EEPROM 60 of the tag 50 under the control by the tab side communicating section 61 of the tag 50.

The printer apparatus 12 is configured as described above so as to be capable of reading out required data from the EEPROM 60 of the tab 50 of the ribbon cartridge 11, updating the data or writing new data into the EEPROM 60.

(2) Configuration of Signal Processing Section 100 in Printer Apparatus 12

Figure 15:
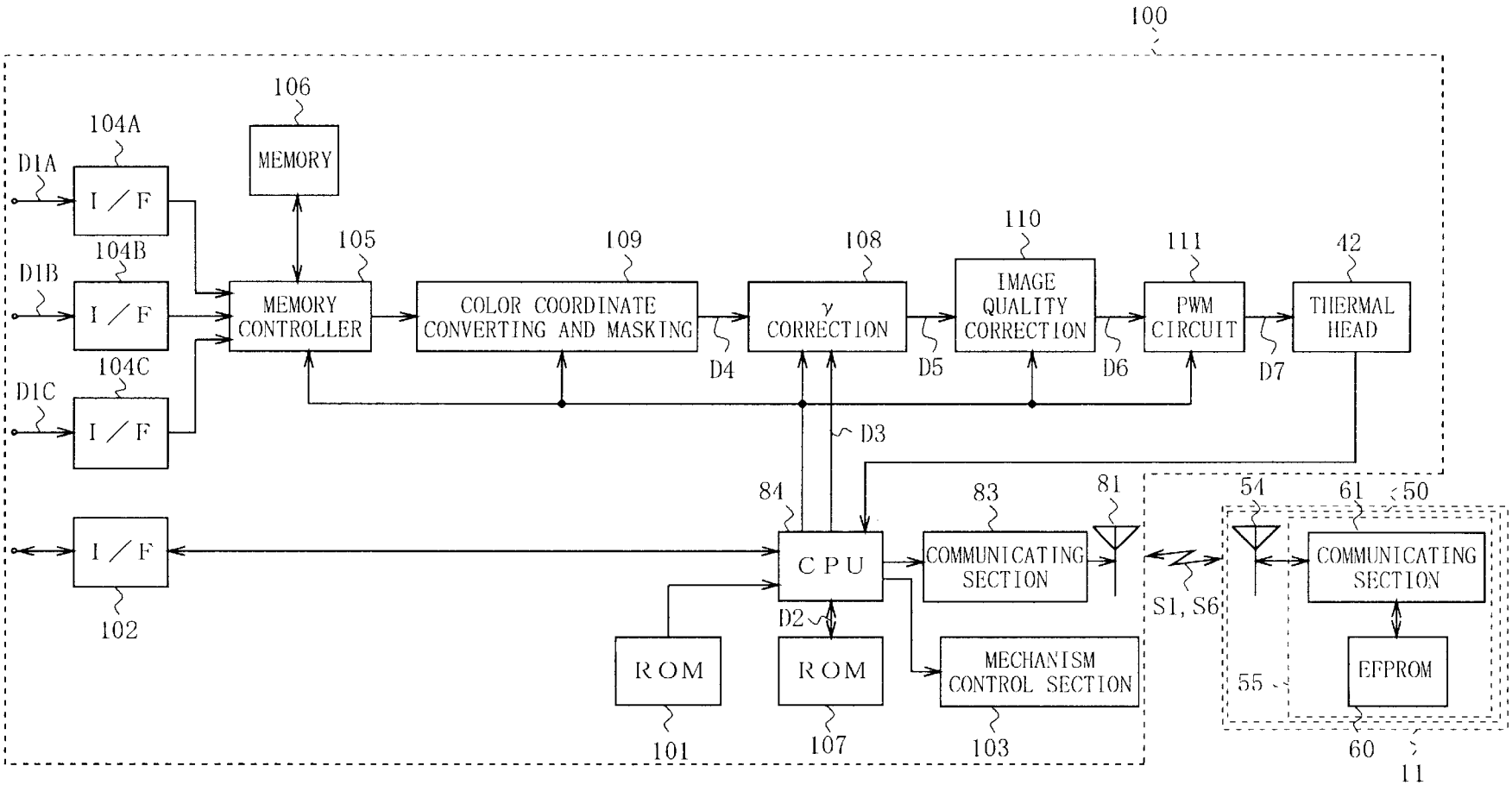
FIG. 15 is a block diagram showing a configuration of a signal processing section of the printer apparatus.

Disposed in the console 30 of the printer apparatus 12, as shown in FIG. 15, is a signal processing section 100 which is composed of a micro computer comprising the CPU 84 described above.

When the CPU 84 recognizes that the ribbon cartridge 12 is charged into the console 30 on the basis of an output from a sensor which is not shown, the CPU 84 controls the printer side communicating section 83 to read out various kinds of data described above with reference to FIG. 11 which is stored in the EEPROM 60 in the tag 55 of the ribbon cartridge 12 and stores the read various kinds of data into a RAM 101.

Then, the CPU 84 switches an operation mode to a corresponding operation mode on the basis of data of a kind code out of the various kinds of data stored in the RAM 101. In addition, the CPU 84 sends out required data out of the various kinds of data stored in the RAM 101 to an external appliance such as a personal computer, thereby allowing a monitor as the external appliance to display information on a kind of the ink ribbon 20, the number of sheets usable for photographic printing, the number of used sheets or the like in this ribbon cartridge 11.

When a photographic printing instruction is given from the external appliance by way of an interface circuit 102, on the other hand, the CPU 84 drives a corresponding mechanism by way of a mechanism control section 103, thereby allowing a photographic printing sheet to be taken out and carried from the paper tray 40 charged in the console 30, and held in a condition where the sheet is sandwiched between the thermal head 42 and the platen 41 with the ink ribbon 20 of the ribbon cartridge 11 interposed.

Furthermore, the CPU 84 allows image data D1A through D1C of each color which is given together with the photographic printing instruction to be taken by way of corresponding interface circuits 104A through 104C, respectively and stored into a corresponding memory area of a memory 106 by way of a memory controller 105. In case of this embodiment, data of a red component, a green component and a blue component of an image is given as the image data D1A through D1C of each color.

When all the image data D1A through D1C of each color is stored from the external appliance into the memory 106, the CPU 84 reads out a corresponding operation mode and γ data D2 of temperature in an amount of an ink color out of operation modes and γ data of each ink color at each temperature preliminarily stored in the ROM 107 on the basis of temperature data supplied from a thermistor disposed on the thermal head 42 and a media kind code out of the various data which has been taken into the RAM 101.

The CPU 84 corrects the γ data D2 of each ink color read out from the ROM 107 on the basis of the manufacturing dispersion correcting data of a corresponding ink color which is stored in the ROM 101 at that time.

Speaking concretely of a case where manufacturing dispersion correcting data of a certain color has a value of $+\alpha$, for example, the CPU 84 multiplies the γ data D2 of the color read out of the ROM 107 by the following Equation:

$$1 + \frac{\alpha}{100} \tag{1}$$

thereby correcting the data.

In a case where the manufacturing dispersion correcting data has a value of $-\alpha$, the CPU 84 multiplies the γ data D2 of the color read out of the ROM 107 by the following Equation:

$$1 - \frac{\alpha}{100} \tag{2}$$

thereby correcting the data.

When the γ data D2 read out of the ROM 107 is a graph K1 traced in a solid line in FIG. 16 is obtained as a result, for example, this γ data D2 is corrected into a graph K2 or K3 traced in a dashed line in FIG. 16 and corrected γ data D3 is given to a γ correcting circuit 108. The γ correcting circuit 108 stores the γ data D3 into an EEPROM which is not shown disposed in the circuit.

Successively, the CPU 84 controls the memory controller 105 so as to read out the image data D1A through D1C of the red component, green component and blue component stored in the memory 106 line by line, and send out the image data to a color coordinate converting and masking processing circuit 109.

On the basis of the supplied image data D1A through D1C, the color coordinate converting and masking processing circuit 109 converts an obtained color coordinate of an obtained color image from an RGB series to a YMC series, and sends out image data D4 of a color which is designated by the CPU 84 out of obtained yellow component, magenta component and cyanic component line by line to the γ correcting circuit 108 while performing the so-called masking processing to eliminate data not higher than a threshold value.

The γ correcting circuit 108 selects the γ data D3 of the designated color out of the γ data D3 of the colors which is stored in the EEPROM under control by the CPU 84, performs γ correction processing of the image data D4 given from the color coordinate converting and masking processing circuit 109 on the basis of the γ data D3 and sends out obtained γ correction image data D5 to an image quality correcting circuit 110.

The image quality correcting circuit 110 performs predetermined image quality correcting processing for improving image quality, such as an edge correction processing of the γ correction image data D5 that makes an edge conspicuous in an image or the like, and sends out obtained image quality correction image data D6 to a PWM circuit 111.

The PWM circuit 111 performs pulse duration modulation of the progressively supplied image quality correcting image data D6 in an amount of a line at 256 steps, for example, and sends out obtained photographic printing data D7 to the thermal head 42. As a result, photographic images are progressively printed on the photographic printing sheets in the amount of a line on the basis of the photographic printing data D7 by way of the thermal head 42.

Furthermore, the CPU 84 drives the mechanism by way of the mechanism control section 103, thereby feeding the ink ribbon 20 of the ribbon cartridge 11 integrally with the photographic printing sheets in the amount of a line and then executing photographic printing in a color by performing photographic printing as described above while controlling the memory controller 105, the color coordinate converting and masking processing circuit 109, the γ correcting circuit 108, the image quality correcting circuit 110 and the PWM circuit 111.

Furthermore, the CPU 84 drives the mechanism by way of the mechanism control section 103, thereby bringing the photographic printing sheet into contact with an ink layer of a next color which is coated on the ink ribbon 20 of the ribbon cartridge 11 and pressing the thermal head 42 to the photographic printing sheet by way of the ink ribbon 20, then executing photographic printing on the basis of the image data D4 of the color as described above and subsequently photographically printing an image on the basis of the image data D4 of the rest color in a corresponding color by progressively repeating similar operations.

The printer apparatus 12 is configured so as to sequentially photographically print the yellow component, the magenta component and the cyanic component of the image in the corresponding colors on the basis of the supplied image data D1A through D1C as described above, thereby being capable of photographically printing the image in full colors by overlapping these colors on the basis of the image data D1A through D1C.

Figure 17:
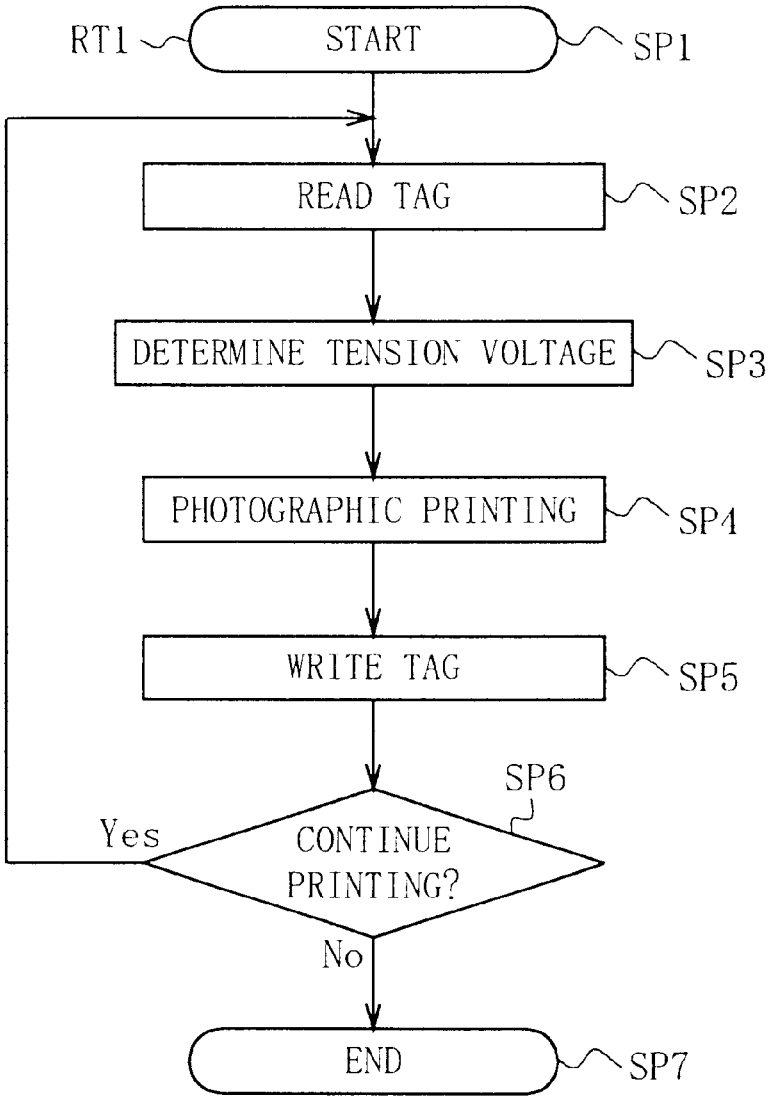
FIG. 17 is a flow chart showing a tension control processing sequence.

During a photographic printing operation, on the other hand, the CPU 84 controls a tension of the ink ribbon 20 of the ribbon cartridge 11 in a tension control processing sequence RT1 shown in FIG. 17 on the basis not only of the printing control described above but also of the data of the number of usable photographic printing sheets and the number of used sheets stored in the EEPROM 60 of the tag 55 attached to the ribbon cartridge 11.

Concretely speaking, the CPU 84 starts the tension control processing sequence RT1 at step SP1 when the printing instruction is given from the external appliance, and reads out the number of usable photographic printing sheets and the number of used sheets from the EEPROM 60 of the tag 55 of the ribbon cartridge 11 at a successive step SP2 by controlling the printer side communicating section 83.

Successively, the CPU 84 proceeds to step SP3 and calculates driving voltages to be applied to motors (hereinafter referred to as a supply spool driving motor and a take-up spool driving motor) which give rotating forces to the first and second torque limiters 43 and 44 (FIG. 6) described above, on the basis of the data representing the number of the usable photographic printing sheets and the number of used sheets, which have been read out, the length per screen of each kind of the ink ribbon 20 (corresponding to the three colors of Y, M and C) of each kind and type of the apparatus which preliminarily stored into the ROM 107, the radius of the spools (supply spool 21 and take-up spool 22) and the thickness of the ink ribbon 20.

Concretely speaking, the number of the usable photographic printing sheets is represented by N, the number of used sheets is designated by n, the length of the ink ribbon 20 per screen is denoted by L, the radius of the spools is represented by r and the thickness of the ink ribbon 20 is designated by h, and the CPU 84 calculates the following Equation:

$$r_s = \sqrt{\frac{L \times (N-n) \times h + \pi \times r^2}{\pi}} \tag{3}$$

thereby calculating a radius $r_s$ of the supply spool 21 including thickness of the ink ribbon 20 at this time.

Utilizing a calculated result and representing a value of a desired tension by F, the CPU 84 calculates the following Equation:

$$T_s = F \times r_s \tag{4}$$

thereby calculating a value of a torque $T_s$ to be applied to the supply spool 21 at this time.

On the basis of this calculation result, the CPU 84 calculates a value of the driving voltage to be applied to the supply spool described above and applies a driving voltage of the calculated voltage value to the driving motor for the supply spool by way of the mechanism control section 103.

On the basis of a number of used ink ribbons 20, the CPU 84 similarly calculates the following Equation:

$$r_T = \sqrt{\frac{L \times n \times h + \pi \times r^2}{\pi}} \tag{5}$$

thereby calculating a radius $r_T$ of the take-up spool 22 including the thickness of the ink ribbon 20 and the CPU 84 calculates, utilizing a calculation result thus obtained, the following Equation:

$$T_T = F \times r_T \tag{6}$$

thereby calculating a value of a torque $T_T$ to be given to the take-up spool 22.

On the basis of this calculation result, the CPU 84 calculates the driving voltage to be applied to the driving motor for the take-up spool described above and applies a driving voltage of a calculated voltage value to the driving motor for the take-up spool by way of the mechanism control section 103, thereby giving a predetermined tension F to the ink ribbon 20 of the ribbon cartridge 11.

Successively, the CPU 84 proceeds to step SP4 to allow an image on a screen to be photographically printed by controlling the memory controller 105, the color coordinate converting and masking circuit 109, the γ correcting circuit 108, the image quality correcting circuit 110 and the PWM circuit 111 as described above.

Successively, the CPU 84 proceeds to step SP5 to communicate with the tag side communicating section 61 of the tag 55 of the ribbon cartridge 11 by way of the printer side communicating section 83, thereby allowing the number of used sheets stored in the EEPROM 60 of the tag 55 to be rewritten into a value by subtraction of 1.

Successively, the CPU 84 proceeds to step SP6 to judge whether or not the photographic printing is to be carried out continuously hereafter and when an affirmative result is obtained, the CPU 84 returns to step SP2 or when a negative result is obtained, the CPU 84 proceeds to step SP7 to terminate the tension control processing sequence RT1.

The CPU 84 controls the tension of the ink ribbon 20 of the ribbon cartridge 11 during the printing operation as described above.

(3) Operation and Effect of the Embodiment

In the printer system 10 which has the configuration described above, the various kinds of data preliminarily stored in the EEPROM 60 is read in the contactless communication mode out of the EEPROM 60 in the tag 50 attached to the ink ribbon cartridge 11 by the CPU 84 of the printer apparatus 12 when the ink cartridge 11 is charged into the printer apparatus 12.

On the basis of the kind data out of the various kinds of data read out of the tag 50, the CPU 84 of the printer apparatus 12 switches an operation mode to a mode matched with ink ribbon of the ink ribbon cartridge 11 and corrects the γ data D2 to be used for printing on the basis of the manufacturing dispersion correcting data. Furthermore, the CPU 84 controls the tension of the ink ribbon 20 during the printing operation on the basis of the number of the data of the sheets usable for photographic printing and the number of used sheets out of the various kinds of data read out of the tag 50.

Accordingly, the printer system 10 is capable of imparting data required for printing such as the kind data of the ink ribbon 20 to the ribbon cartridge 11 (ink ribbon 20) while effectively preventing data loss and data alteration, thereby effectively preventing a printed image from being degraded, for example, due to the mismatch between an operation mode set by the printer apparatus 12 and a kind of the ink ribbon 20 of the ribbon cartridge 11.

Since the printer apparatus 12 automatically corrects the γ data D2 of the colors on the basis of the data for correcting the manufacturing dispersion of the colors of the ink ribbon 20 of the ribbon cartridge 11, the printer system 10 is capable of preventing color balance of the printed image from being unstable due to the manufacturing dispersion of the ink having different colors.

Since the printer apparatus 12 controls the tension of the ink ribbon 20 during the printing operation on the basis of the number of ink ribbons 20 usable for photographic printing and the number of used ink ribbons 20 in the ribbon cartridge 11, and progressively updates the number of used ink ribbons to a correct value, the printer system 10 is capable of controlling the tension of the ink ribbon 20 with high precision in the printer apparatus 12, thereby being capable of preventing printing wrinkles, color deviation in the feeding direction and skew from being caused due to an error in tension control precision.

Since the tag 50 which has preliminarily stored the data required for printing control is disposed in the ribbon cartridge 11 and the printer apparatus 12 is capable of freely reading out or updating the data stored in the tag 50 by the contactless communication, the configuration described above is capable of preventing occurrence of degradation of a printed image due to the mismatch between an operation mode automatically set by the printer apparatus 10 and the kind of the ink ribbon 20 of the ribbon cartridge 11 or the like, unstability of the color balance of the printed image due to the manufacturing dispersion of the ink having the different colors of the ink ribbon 20, and the printing wrinkles, the color deviation in the feeding direction and the skew due to inaccurate tension control for the ink ribbon 20, thereby making it possible to realize a printer system which is capable of securely and effectively preventing a quality of the printed image from being degraded.

(4) Other Embodiments

Though the data such as the management data, the name of apparatus, the kinds of the ink ribbon 20, the number of usable sheets for photographic printing, the number of sheets that have been used, the address of the ink ribbon 20, the name of a client (OEM), the specifications for the company, the ribbon lot data and the photographic printing paper lot data and the manufacturing dispersion correcting data for correcting the manufacturing dispersion of the ink having the different colors of the ink ribbon 20 is stored in the EEPROM 60 of the tag 50 as described above with reference to FIG. 11 in the embodiment described above, the present invention is not limited by the embodiment and other various kinds of data can be stored.

When the ink ribbon 20 is of a self laminate type, for example, in this case, a value of a voltage to be applied to the thermal head 42 for printing a laminate can be stored in the EEPROM 60 of the tag 50 or data such as a photographic printing period can be stored in the EEPROM 60 of the tag 50 in the case where the ink ribbon 20 is of a high-speed printable type so that the printer apparatus 12 controls utilizing this data during the printing operation.

Furthermore, a commercial message or character data such as "win" or "lose" for prize competition can be stored in the EEPROM 60 of the tag 50 so that the printer apparatus 12 reads out the data and allows the data to be displayed on the liquid crystal display panel 37 or a monitor of the external appliance.

Since the printer system according to the present invention is capable of communicating with the ink ribbon side communicating section 61 of the tag 50 even in a condition where the ink ribbon 20 is wrapped or packed, the system can be configured so as to sequentially record circulating routes of the ink ribbon 20 so that data of the circulating routes can be used to prevent recurrence of a trouble in a case where the ink ribbon 20 is troubled.

Though the data for correcting the manufacturing dispersion of each ink having the different colors of the ink ribbon 20 is stored in the tag 50 of the ribbon cartridge 11 and the printer apparatus 12 corrects the γ data D2 on the basis of the manufacturing dispersion correcting data in the embodiment described above, the present invention is not limited by the embodiment and preliminarily corrected γ data D3 can be stored in the tag 50 of the ribbon cartridge 11, for example, so that the printer apparatus 12 performs the γ correction processing utilizing the γ data D3.

In this case, a discrimination flag which judges whether or not to use the γ data D3, for example, can be stored in the EEPROM 60 of the tag 50 of the ribbon cartridge 11 so that the γ correction processing is performed using the γ data D3 only when the discrimination flag is erected.

Though the tag 50 is bended to the rear surface of the collar portion 21A of the supply spool 21 in the embodiment described above, the present invention is not limited by the embodiment and the tag 50 can be attached to a rear surface or a front surface of the collar portion 22A of the take-up spool 22, or disposed on a surface of a portion of the supply spool 21 or the take-up spool 22 around which the ink ribbon 20 is to be wound, in the supply spool 21 or the take-up spool 22, at any location on a surface of the holder 23 of the ribbon cartridge 11, in the holder 23 or another location which is selectable widely.

Though the tag 50 has a ring-like shape in the embodiment described above, the present invention is not limited by the embodiment and the tag 50 can have another shape which is selectable widely. Though the tag 50 which has the ring-like shape uses the antenna having the loop-like shape in the embodiment described above, the present invention is not limited by the embodiment and the antennae can have another shape which is selectable widely dependently, for example, on a shape of the tag.

Figure 18A:
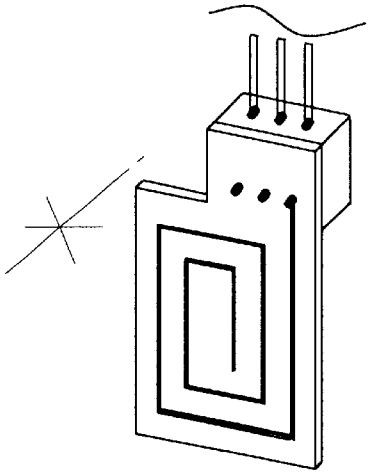
FIGS. 18A, 18B, 18C and 18D are schematic perspective views descriptive of other embodiments.
Figure 18B:
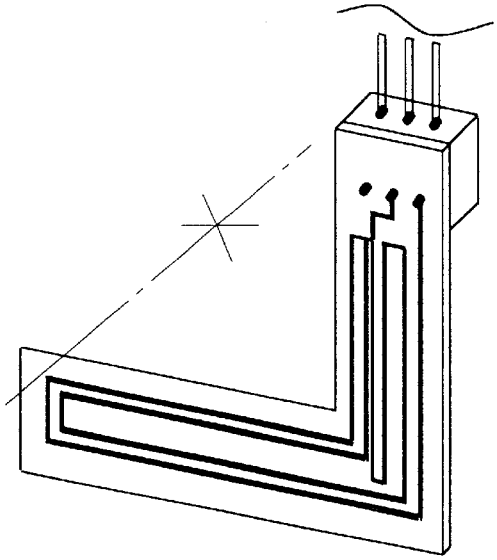
Figure 18C:
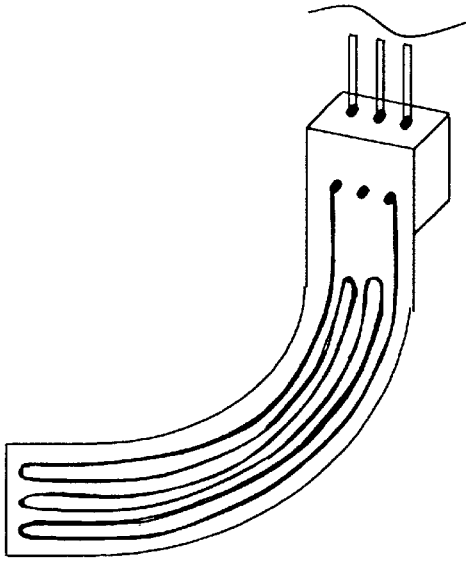
Figure 18D:
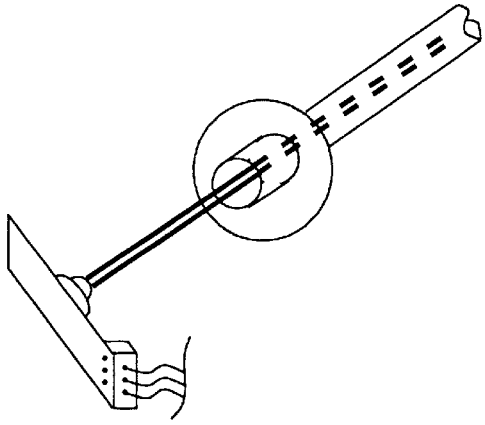

Though the tag side antenna 54 and the printer side antenna 81 have the loop-like shape in the embodiment described above, the present invention is not limited by the embodiment and the tag side antenna 54 and the printer side antenna 81 can be configured so as to have, for example, a rectangular shape as shown in FIG. 18A, an L-shape as shown in FIG. 18B or a shape of a crescent moon as shown in FIG. 18C. Furthermore, the printer side antenna 81 can be configured so as to have a rod-like shape as shown in FIG. 18D. and the tag side antenna 54 and the printer side antenna 81 can have other shapes which are selectable widely.

Though the tag side antenna 54 and the printer side antenna 81 are formed as the patterns on the printed wiring plates 51 and 80 in the embodiment described above, the present invention is not limited by the embodiment and various other forming methods are widely applicable to the antennae.

Though the tag 50 has a three-layer structure consisting of the printed wiring plate 51, the protective film 52 and the protective sheet 53 in the embodiment described above, the present invention is not limited by the embodiment and various other structures are applicable to the tag 50.

Though the present invention is applied to the printer system 10 which uses the ink ribbon 20 as a printing medium in the embodiment described above, the present invention is not limited by the embodiment and the present invention is widely applicable, for example, to a printer system using a printing medium composed of a rolled printing medium (photographic printing paper or photographic printing film) which develops a color by itself, a printer system like a bubble jet printer system using an ink cartridge charged with a liquid coloring material (ink) as a printing medium and a printer system such as a color copy system using a toner cartridge charged with a powdery coloring material (toner) as a printing medium.

In this case, the tag 50 can be attached to the roll core around which the printing medium which develops the color by itself is wound or the cartridge accommodating the ink or the toner and an antenna can be disposed at a corresponding location on a side of the printer apparatus to enable communication with the tag 50.

Though the non-volatile memory (EEPROM 60) is used as memory to store the various kinds of data described with reference to FIG. 11 in the embodiment described above, the present invention is not limited by the embodiment and various other memory means is widely usable so far as it can store the various kinds of data described with reference to FIG. 11.

Though the tag side communicating section 61 and the printer side communicating section 83 are configured as data storage and communicating means shown in FIG. 9 or 14 in the embodiment described above, the present invention is not limited by the embodiment, and the tag side communicating section 61 and the printer side communicating section 83 can have various other configurations so far as the communicating sections are capable of communicating with each other in a contactless mode.

Though the CPU 84 of the printer apparatus 12 updates the number of used sheets stored in the EEPROM 60 of the tag 50 by the subtraction of 1 each time the image on a screen is printed in the embodiment described above, the present invention is not limited by the embodiment and the number of used sheets stored in the EEPROM 60 of the tag 50 can be updated at a stage to complete printing of all images when images are printed successively.

However, updating of the number of used sheets stored in the EEPROM 60 of the tag 50 each time the image on a screen is printed as in the embodiment provides an advantage to allow the EEPROM 60 of the tag 50 to hold a correct number of used sheets even in a case, for example, where the power source of the printer apparatus 12 is turned off in the course of successive photographic printing operations.

Though the photographic printing means which prints an image on the basis of photographic printing data by allowing a coloring material to adhere to a photographic printing medium or allowing a photographic printing medium which develops a color by itself to develop the color is configured of the signal processing section 100 composed as shown in FIG. 15 and the mechanism which is not shown in the embodiment described above, the present invention is not limited by the embodiment and various other configurations can be applied.

According to the present invention as described above, in the printer system, the printing medium comprises: a first antenna; memory means which stores predetermined control data; and first communicating means which communicates with an outside by way of the first antenna, and reads out the control data out of the memory means and outputs the data to the outside by way of the first antenna in response to a request from the outside, and the printer apparatus comprises: photographic printing means which prints an image on the basis of photographic printing data by allowing the coloring material of the printing medium to adhere to the photographic printing medium or allowing the photographic printing means which develops the color by itself to develop the color; a second antenna which is disposed in correspondence to the first antenna; second communicating means which communicates by non-communication contact with the first communicating means by way of the second and first antennae; and control means which reads out the control data from the storage means by way of the second and first communicating means and executes predetermined control processing on the basis of the control data which is read out. In this way it is possible to realize a printer system which is capable of effectively preventing loss and alteration of necessary data, can execute effective photographic printing control on the basis of the control data and thus certainly and effectively preventing a quality of printed image from being degraded.

Furthermore, the printing method comprises the steps of: disposing memory means integrally with the photographic printing medium to which the coloring material is to adhere or the photographic printing medium which develops the color by itself and storing predetermined control data into the memory means; and reading out the control data stored in the memory means by the contactless communication and controlling the photographic printing operation on the basis of the control data which is read out. In this way it is possible to realize a printing method which is capable of executing effective photographic printing control on the basis of the control data while effectively preventing loss and alteration of necessary data and thus certainly and effectively preventing a quality of printed image from being degraded.

Furthermore, the printer apparatus comprises: communicating means which communicates contactlessly with data storage and communicating means which is disposed integrally with the coloring material or the photographic printing medium which develops the color by itself, and has a data storage function and a contactless communicating function; and control means which reads out control data preliminarily stored in the data storage and communicating means by way of the communicating means, and executes predetermined control processing on the basis of the control data which is read out. In this way, it is possible to realize a printer apparatus which is capable of executing effective photographic printing control without having a user input data necessary for the photographic printing control and thus effectively preventing a quality of printed image from being degraded with no necessity of troublesome inputting.

Furthermore, the printing method comprises the steps of: communicating with data storage and communicating means which is disposed integrally with the coloring material or the photographic printing medium which develops the color by itself and has a data storage function and a contactless communicating function and reading out control data preliminarily stored in the data storage and communicating means by contactless communication; and controlling an photographic printing operation on the basis of the control data which is read out. In this way, it is possible to realize a printing method which is capable of executing effective photographic printing control without having a user input data necessary for the photographic printing control and thus effectively preventing a quality of printed image from being degraded with no necessity of troublesome inputting.

Furthermore, the ink ribbon comprises: an antenna disposed integrally with a ribbon with ink on a surface; communicating means for performing communication with an outside by way of the antenna; and memory means for storing data, wherein the data obtained by the communication with the outside is stored in the memory means at need, and/or the data stored in the memory means is read out at need and output to the outside by the communication. In this way it is possible to realize an ink ribbon which is capable of being equipped with necessary data for photographic printing control while effectively preventing loss and alteration thereof and thus certainly and effectively preventing a quality of printed image from being degraded.

Furthermore, the printing medium comprises: an antenna disposed integrally with the coloring material or the photographic printing medium which develops the color; communicating means for performing communication with an outside by way of the antenna; and memory means for storing data, wherein the data obtained by the communication with the outside is stored into the memory means as occasion demands and/or the data stored in the memory means is read out as occasion demands and output to the outside by the communication. In this way it is possible to realize a printing medium which is capable of being equipped with necessary data for photographic printing control while effectively preventing loss and alteration thereof and thus certainly and effectively preventing a quality of printed image from being degraded.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. A printer system composed of a printing medium and a printer apparatus, wherein said printing medium comprises:

at least one ink ribbon which has coloring material coated on a surface of the ribbon which develops a color by itself;

a first antenna;

memory means which stores predetermined control data; and first communicating means which communicates with an outside by way of said first antenna, and reads out said control data out of said memory means and outputs the data to the outside by way of said first antenna in response to a request from the outside, and said printer apparatus comprises:

photographic printing means which prints an image on the basis of photographic printing data by allowing said coloring material on said ink ribbon to adhere to the photographic printing medium or allowing said photographic printing means which develops the color by itself to develop the color;

a second antenna which is disposed in correspondence to said first antenna;

second communicating means which communicates by non-communication contact with said first communicating means by way of said second and first antennae; and control means which reads out said control data from said memory means by way of said second and first communicating means and executes predetermined control processing on the basis of said control data which is read out.

2. The printer system according to claim 1, wherein said control data includes data representing predetermined data relating to the ink ribbon and said control means switches an operation mode of the photographic printing means to the corresponding mode on the basis of said predetermined data.

3. The printer system according to claim 1, wherein said control data includes manufacturing dispersion correcting data for correcting manufacturing dispersion of said coloring material from said ink ribbon on said photographic printing medium which develops the color by itself, and said control means corrects said photographic printing data on the basis of said manufacturing dispersion correcting data and then controls said photographic printing means so as to execute photographic printing on the basis of said photographic printing data.

4. The printer system according to claim 1, wherein said control data includes data of a number of sheets usable for photographic printing and a used amount of said ink ribbon, and said control means controls said photographic printing means so as to apply a predetermined tension to said ink ribbon on the basis of said number of sheets usable for photographic printing and said used amount.

5. The printer system according to claim 4, wherein said first communicating means has a function to store said control data given from the outside into said memory means in response to a request from the outside, and said control means communicates with said first communicating means by way of said second communicating means to rewrite data of said used amount of said ink ribbon stored in said memory means dependently on the used amount of said ink ribbon.

6. The printer system according to claim 1, wherein said memory means comprises a non-volatile memory.

7. The printer system according to claim 1, wherein said first communicating means and said memory means are formed on a semiconductor integrated circuit chip.

8. The printer system according to claim 7, wherein said first antenna is formed as a pattern on a first wiring plate and said semiconductor integrated circuit is mounted on said first wiring plate so as to be electrically connected to said first antenna.

9. The printer system according to claim 1, wherein said second antenna is formed as a pattern on a second wiring plate.

10. A printing method which prints an image using at least one ink ribbon which has coloring material coated on a surface of a ribbon comprising the steps of:

disposing memory means integrally with the ink ribbon and storing predetermined control data into said memory means; and reading out said control data stored in said memory means by contactless communication and controlling said photographic printing operation on the basis of said control data which is read out.

11. The printing method according to claim 10, wherein said control data includes data representing characteristic data of the ink ribbon, and switching to the operation mode at the beginning of the printing operation on the basis of said characteristic data during control processing.

12. The printing method according to claim 10, wherein said control data includes manufacturing dispersion correcting data for correcting manufacturing dispersion of said coloring material or said photographic printing medium which develops the color by itself, and said photographic printing information is corrected on the basis of said manufacturing dispersion correcting data as said control processing at said second step.

13. The printing method according to claim 10, wherein said control data includes data of the number of sheets usable for photographic printing and a used amount of said ink ribbon, and a tension of said ink ribbon at said photographic printing operation is controlled on the basis of said number of sheets usable for photographic printing the used amount of the ink ribbon.

14. The printing method according to claim 13, comprising the step of:

rewriting said data of the used amount of said ink ribbon stored in said memory means of said printing medium in accordance with used amount of the ink ribbon.

15. A printer apparatus comprising:

photographic printing means which prints an image on the basis of photographic printing data by adhering a coloring material to a photographic printing medium or allowing at least one ink ribbon which has a coloring medium on the surfaces of the ribbon;

communicating means which communicates contactlessly with data storage and communicating means which is disposed integrally with the ink ribbon which develops the color by itself, and has a data storage function and a contactless communicating function; and control means which reads out control data preliminarily stored in said data storage in said data storage and communicating means by way of said communicating means, and executes predetermined control processing on the basis of said control data which is read out.

16. The printer apparatus according to claim 15, wherein said control data includes data representing characteristic data of said ink ribbon, and said control means switches an operation mode of the photographic printing means to a corresponding mode on the basis of said characteristic data.

17. The printer apparatus according to claim 15, wherein said control data includes manufacturing dispersion correcting data for correcting manufacturing dispersion of said ink ribbon; and said control means controls said photographic printing means so as to correct said photographic printing data on the basis of said manufacturing dispersion correcting data and then prints the image on the basis of said photographic printing data.

18. The printer apparatus according to claim 15, wherein said control data includes data of a number of sheets usable for photographic printing and a used amount of said ink ribbon, and said control means controls said photographic printing means so as to apply a predetermined tension to said ink ribbon on the basis of said number of sheets usable for the photographic printing and said used amount.

19. The printer apparatus according to claim 18, wherein said control means communicates with said data storage and communicating means by way of said communicating means, and rewrites the data of said used amount of said ink ribbon stored in said data storage and communicating means dependently on an actual used amount of said ink ribbon.

20. A printing method which prints an image on the basis of photographic printing data by adhering a coloring material on the surface of at least one ink ribbon to a photographic printing medium, comprising the steps of:

communicating with data storage and communicating means which is disposed integrally with said ink ribbon and has a data storage function and contactless communicating function, and reading out control data preliminarily stored in said data storage and communicating means by contactless communication; and controlling an photographic printing operation on the basis of said control data which is read out.

21. The printing method according to claim 20, wherein said control data includes data representing the characteristics of said ink ribbon which develops the color by itself, and switching to an operation mode at a time of said photographic printing operation to a corresponding mode on the basis of said control data.

22. The printing method according to claim 20, wherein said control data includes manufacturing dispersion correcting data for correcting manufacturing dispersion of said photographic printing object which develops ink ribbon for coloring said photographic printing medium, and said photographic printing data is corrected on the basis of said manufacturing dispersion correcting data said control processing.

23. The printing method according to claim 20, wherein said control data includes data of a number of sheets usable for photographic printing and a used amount of said ink ribbon, and a tension of said ink ribbon is controlled at the time of said photographic printing operation on the basis of said number of sheets used and usable for photographic printing.

24. The printing method according to claim 23, comprising the step of:

rewriting said data of the used amount of said ink ribbon stored in said data storage and communicating means dependently on an actual used amount of the ink ribbon.

25. An ink ribbon comprising:

a ribbon coated with ink on a surface;

an antenna disposed integrally with said ribbon;

communicating means for performing communication with an outside by way of said antenna; and memory means for storing data, wherein said data obtained by said communication with said outside is stored in said memory means as needed, and/or said data stored in said memory means is read out as needed and output to said outside by said communication.

26. The ink ribbon according to claim 25, wherein data representing characteristics of said ink ribbon is preliminarily stored in said memory means.

27. The ink ribbon according to claim 25, wherein manufacturing dispersion correcting data for correcting manufacturing dispersion of said ink is preliminarily stored as said data in said memory means.

28. The ink ribbon according to claim 25, wherein that data representing a number of sheets usable for photographic printing is preliminarily stored as said data in said memory means and that data representing a number of used sheets is rewritably stored in said memory means.

29. The ink ribbon according to claim 25, wherein said memory means comprises a non-volatile memory.

30. The ink ribbon according to claim 25, wherein said communicating means and memory means are formed in a semiconductor integrated circuit chip.

31. The ink ribbon according to claim 30, wherein said antenna is formed as a pattern on a wiring plate and said semiconductor integrated circuit chip is mounted on said wiring plate so as to be electrically connected to said antenna.

32. The ink ribbon according to claim 25, comprising:

a first spool around which said ribbon is wound;

a second spool which holds an end of said ribbon drawn out from said first spool; and a holder which holds said first and second spool in parallel and rotatably.

33. A printing medium comprising:

a coloring material formed on the surface of at least one ink ribbon to be adhered to a photographic printing object or a photographic printing medium which develops a color by photographic printing treatment for visibly displaying a shape or an image on the basis of photographic printing data;

an antenna disposed integrally with said coloring material or said photographic printing medium which develops the color;

communicating means for performing communication with an outside by way of said antenna; and memory means for storing data, wherein said data obtained by said communication with said outside is stored into said memory means as occasion demands and/or said data stored in said memory means is read out as occasion demands and output to said outside by said communication.

34. The printing medium according to claim 33, wherein data representing characteristics of said coloring material or said photographic printing medium which develops the color is preliminarily stored in said memory means.

35. The printing medium according to claim 33, wherein manufacturing dispersion correcting data for correcting manufacturing dispersion of said coloring material or said photographic printing medium is preliminarily stored as said data in said memory means.

36. The printing medium according to claim 33, wherein said data is data related to a used amount of said coloring material or said photographic printing medium which develops the color.

37. The printing medium according to claim 33, wherein said memory means comprises a non-volatile memory.

38. The printing medium according to claim 33, wherein said communicating means and memory means are formed in a semiconductor integrated circuit chip.

39. The printing medium according to claim 38, wherein said antenna is formed as a pattern on a wiring plate and the semiconductor integrated circuit chip is mounted on said wiring plate so as to be electrically connected to said antenna.

* * * * *